US006898888B2

(12) United States Patent
Greenhut

(10) Patent No.: US 6,898,888 B2
(45) Date of Patent: May 31, 2005

(54) CARTRIDGE CHAMBERING SYSTEM FOR FIREARMS

(76) Inventor: Paul M. Greenhut, 170 N. Beacon St., Hartford, CT (US) 06105

( * ) Notice: Subject to any disclaimer, the term of this patent is extended or adjusted under 35 U.S.C. 154(b) by 0 days.

(21) Appl. No.: 10/478,530

(22) PCT Filed: May 23, 2002

(86) PCT No.: PCT/US02/16339

§ 371 (c)(1),
(2), (4) Date: Nov. 20, 2003

(87) PCT Pub. No.: WO02/095321

PCT Pub. Date: Nov. 28, 2002

(65) Prior Publication Data

US 2004/0200110 A1 Oct. 14, 2004

Related U.S. Application Data

(60) Provisional application No. 60/293,350, filed on May 24, 2001.

(51) Int. Cl.[7] ..... F41A 3/12
(52) U.S. Cl. ..... 42/18; 42/39.5; 89/33.03
(58) Field of Search ..... 89/33.03; 42/17, 42/18, 39.5

(56) References Cited

U.S. PATENT DOCUMENTS

| | | | |
|---|---|---|---|
| 465,339 | A | 12/1891 | Browning et al. |
| 468,394 | A | 2/1892 | Von Wehrstedt |
| 643,984 | A | 2/1900 | Ross |
| 1,202,707 | A | 10/1916 | Grieco |
| 1,557,627 | A | 10/1925 | Swebilius |

(Continued)

FOREIGN PATENT DOCUMENTS

| | | | |
|---|---|---|---|
| CH | 146031 | 3/1931 | |
| CH | 651 653 A5 * | 9/1985 | ..... 89/33.03 |
| GB | 2 115 910 A | 9/1983 | |

OTHER PUBLICATIONS

United States Statutory Invention Registration H211, published Feb. 3, 1987, Vanderbeck, Combined Ejector–Rammer For Small Arms.

(Continued)

*Primary Examiner*—Stephen M. Johnson
(74) *Attorney, Agent, or Firm*—Cantor Colburn LLP

(57) ABSTRACT

This invention provides two broad features. First, there is a firearm having a movable ramp (20) for receiving a cartridge (12*a*) stripped from a magazine (10) thereon. The ramp (20) is situated behind and below the firing chamber (28) and is movable between a tilted position, in which the ramp (20) guides the cartridge (12*a*) upward as it advances towards the chamber, and an elevated position, in which it supports the cartridge (12*a*) in alignment with the chamber (28). The firearm includes a slide-bolt assembly for advancing cartridges (12*a*) into the chamber, and the ramp (20) and the slide-bolt assembly engage each other such that the ramp (20) moves to the elevated position as the slide-bolt assembly moves towards the chamber (28). Second, there is a firearm adapted for a dual clip (116*a*, 118*a*) magazine (100) so that either of two different types of cartridges (102*a*, 104*a*) may be chosen for firing. The firearm includes a selectable stripping mechanism which has a moveable selector bar (138) that carries a selector cam (132), and a stripper bar (128, 130) associated with each of the clips. Each stripper bar (128, 130) is movable by the select or cam (132) between an "on" position in which it can strip a cartridge from a clip and an opposite "off" position in which it bypasses a cartridge. There is a movable guide ramp (142*a*, 144*a*) associated with each clip (116*a*, 118*a*) for guiding and raising the cartridge to the chamber. The ramps (142*a*, 144*a*) and the slide (122) engage each other via cams (152, 154) such that the ramps (142*a*, 144*a*) move to their elevated positions as the slide (122) moves towards the barrel (26).

4 Claims, 7 Drawing Sheets

U.S. PATENT DOCUMENTS

| | | | | | |
|---|---|---|---|---|---|
| 1,749,726 | A | | 3/1930 | von Frommer | |
| 1,851,696 | A | | 3/1932 | Ekdahl | |
| 1,913,255 | A | | 6/1933 | von Frommer | |
| 2,114,821 | A | | 4/1938 | Thomas | 42/17 |
| 2,365,392 | A | | 12/1944 | Cooley | 89/34 |
| 2,997,924 | A | * | 8/1961 | Rosebush | 89/155 |
| 3,421,408 | A | | 1/1969 | Badali | 89/33 |
| 3,570,366 | A | * | 3/1971 | Nickel | 89/138 |
| 3,740,884 | A | * | 6/1973 | Wilhelm | 42/17 |
| 3,747,249 | A | | 7/1973 | Oullette | 42/50 |
| 3,759,135 | A | | 9/1973 | Tollinger | 89/33 B |
| 4,004,489 | A | | 1/1977 | Johnson et al. | 89/33 SF |
| 4,163,334 | A | * | 8/1979 | Tollinger | 42/25 |
| 4,587,879 | A | | 5/1986 | Savioli | 89/33.25 |
| 4,942,802 | A | | 7/1990 | Stoner | 89/191.01 |
| 5,317,951 | A | * | 6/1994 | Reynolds | 89/160 |
| 5,435,088 | A | | 7/1995 | Bammate | 42/7 |
| 5,615,505 | A | | 4/1997 | Vaid | 42/50 |
| 5,675,110 | A | | 10/1997 | Gyre et al. | 89/33.04 |
| 5,675,924 | A | | 10/1997 | Predazzer | 42/25 |

OTHER PUBLICATIONS

International Search Report for PCT/US02/16339, mailed May 29, 2003, 6 pages.

Written Opinion for PCT/US02/16339, mailed Mar. 22, 2004, 5 pages.

* cited by examiner

CARTRIDGE CHAMBERING SYSTEM FOR FIREARMS

CROSS-REFERENCE TO RELATED APPLICATION

This application claims benefit of U.S. provisional application No. 60/293,350, filed May 24, 2001.

BACKGROUND OF THE INVENTION

1. Field of the Invention

This invention relates to firearms and, in particular, to cartridge handling systems in firearms.

A variety of mechanisms is known in the art for dispensing ballistic cartridges from magazines and then conveying them to the firing chambers of firearms. Of these, the most inherently reliable types are those that utilize the principle of "pre-chambering", i.e., substantially aligning the cartridge with the firing chamber before inserting it into the chamber. In conventional practice, pre-chambering mechanisms are usually combined with "tubular" magazines. This is done because this type of mechanism is inherently large in size, and the shape of tubular magazines allows them to be placed below the weapon's barrel, or in its stock, allowing the critically important area behind the chamber to be devoted to the pre-chambering system. Use of the much more popular "box-clip" type of magazine usually results in a system that is too bulky for use in small arms. An example of conventional practice is found in repeating shot-guns. Their blunt ended cartridges require good alignment for reliable insertion into firing chambers, and to accomplish this they utilize some form of pre-chambering, almost always combined with tubular magazines.

Pistols, being smaller than shoulder weapons such as shotguns, do not have sufficient room to employ tubular magazines. As a result, the pre-chambering concept has seldom, if ever, been attempted in this type of weapon. A search of prior art found nothing that could fairly be called "pre-chambering" used in a pistol. Semi-automatic pistols typically feed cartridges into the firing chamber using a mechanism that relies heavily on the design of the cartridges to tilt, pivot and "wiggle" the cartridges into position. In regard to the projectile (the cartridge front), the rounded shape, which suggests aerodynamics, is more often designed to fit into the opening of the firing chamber when inserted at an angle. The inserted portion becomes a pivot point for a rotation which brings the cartridge into alignment with the chamber. Usually anything more than a small variation in this shape will cause problems. Shapes other than rounded ones tend to be so difficult to feed that a pistol must be designed specifically for each one. Similarly, the material of which the projectile is made is also important, as the chamber opening is usually rather sharp angled, and a soft material may catch on it. These characteristics have greatly hindered the development of a major new innovation in firearms, the "non-lethal" cartridge. This type of cartridge has a projectile made of rubber or plastic, and is intended to deform severely or fragment on impact and, rather than penetrate a human body, deliver a painfull and temporarily debilitating blow without inflicting serious injury. The main intended use of non-lethal cartridges is self defense, which suggests that they should be developed primarily for use in pistols. To be used with existing pistols, the non-lethal cartridges would have to be designed to very closely match the conventional ammunition for which the pistols are designed. The requirements of non-lethal design, however, make this very difficult. The matter is further complicated by the fact that the science of non-lethal cartridge design is still new. There are many opinions on which design features work best in their intended function. Even if a pistol is to be used exclusively with these cartridges, the problems in feeding them will result in the need to dedicate the pistol to a small proportion of possible projectile designs. To put in the specifications a requirement that the non-lethal" projectile have the same shape and hardness of existing "lethal" ones so that they may be used in existing pistols makes it unlikely that the specifications can be met at all.

2. Related Art

U.S. Pat. No. 2,114,821 to Thomas et al, dated Apr. 19, 1938, discloses a mechanism for conveying cartridges from a magazine in the butt of the rifle to the firing chamber. As shown in FIG. 5, the magazine 29 contains two columns of bullets 37. The bullets are staggered (FIG. 3) so that they are arranged in a close-packed configuration with each bullet in one column seated in the crevice defined by two bullets in the other column. Bullets are dispensed from the magazine in a sequential manner, first from one column then from the other. The magazine is divided into several compartments each having two columns of bullets arranged in this way.

German Patent Document No. 146031 to Harlas et al, dated Jun. 16, 1931, appears to disclose a handgun having a magazine that contains multiple parallel columns of bullets. The magazine has only one opening from which bullets are dispensed.

U.S. Pat. No. 1,749,726 to Von Frommer, dated Mar. 4, 1930, discloses a cartridge guide for repeating guns. The gun features a pivoting ramp (cartridge guiding surface 9) that guides cartridges dispensed from magazine 10 towards the chamber.

U.S. Pat. No. 1,913,255 to Von Frommer, dated Jun. 6, 1933, discloses a magazine for repeating rifles. The illustrated weapon includes a pivoting cartridge guide 4 that pivots on the magazine. When the breech bolt is withdrawn, the slide pivots into position. As the breech bolt is shifted forward and a cartridge begins entry into the chamber, the bolt bears against the guide, which pivots out of the way.

U.S. Pat. No. 3,759,135 to Tollinger, dated Sep. 18, 1973, discloses a semi-automatic shotgun in which the magazine is a tube in which the cartridges are placed axially, the nose of each against the base of the one in front of it. A spring at the front of the tube pushes all of them toward the operating mechanism, where the first in line slides onto a pivoting elevator (carrier 16) until it stops. The tubular magazine is normally mounted below the level of the firing chamber, so the elevator then pivots to elevate the cartridge into alignment with the barrel. The cartridge is then inserted into the firing chamber.

As previously stated, arrangements like the one shown by Tollinger are not known to be used with "box" type magazines. The reason seems to be that the pivoting elevator system is inherently bulky, and when this is combined with the bulk of a box magazine, the result is a mechanism that is too large to be practical in a firearm. A tubular magazine is also bulky, but its shape allows mounting it below the barrel or inside the stock of a shoulder arm. Pistols have no stocks and short barrels, so tubular magazines are not practical for them. Pistols almost universally use box-clip-type magazines.

SUMMARY OF THE INVENTION

A first broad aspect of this invention provides an improved firearm comprising a frame that carries a barrel having a chamber therein, a firing mechanism, and a slide-bolt assembly mounted on the frame for movement between a rearward position and a forward position, the slide-bolt assembly being configured for stripping cartridges from a magazine mounted on the frame and for advancing the cartridges towards the barrel as the slide-bolt assembly moves from a reward position to a forward position. The improvement comprises a movable ramp on the firearm. The ramp is movable between a tilted position, in which the ramp is positioned for contact by the front tip of a cartridge stripped from a magazine mounted on the frame, and for guiding the front tip of the cartridge upward as it advances towards the barrel, and an elevated position, in which the ramp is positioned to support a cartridge thereon in alignment with the barrel. The ramp and the slide-bolt assembly are configured to engage each other such that as the slide-bolt assembly moves towards the barrel, the ramp is moved from the tilted position to the elevated position.

According to one aspect of this invention, the firearm may comprise a guide member situated above the ramp to cooperate with the ramp, when the ramp is in its elevated position, to define a pre-chamber within which a cartridge from the magazine can be disposed for alignment with the chamber before it is advanced into the chamber.

According to yet another aspect of this invention, the firearm may comprise a lift cam and follower engagement between the ramp and the slide-bolt assembly. Optionally, the cam has a raising surface and the follower does not engage the raising surface of the lift cam until the slide-bolt assembly is advanced to a position sufficient to strip a cartridge from a magazine mounted in the frame.

According to another aspect of this invention, the firearm as described above preferably has a magazine mounted thereon.

In another broad aspect, this invention provides an improved firearm comprising a frame that carries a barrel having a chamber therein, a firing mechanism, and a slide-bolt assembly mounted on the frame for movement between a rearward position and a forward position. The improvement comprises that the frame be configured for receiving at least one magazine removably mounted thereon to provide two cartridge clips mounted in the frame and that there is a selectable stripping mechanism carried on the frame. The selectable stripping mechanism comprises a selector button that is movable between a first position and a second position, a selector cam carried by the selector button, and a stripper bar associated with each of two clips mounted in the frame. Each stripper bar is carried on the frame such that it bears on the selector cam and so that it is movable between an "on" position in which it can strip a cartridge from an associated clip as the slide moves forward, and an opposite "off" position in which the stripper bar bypasses a cartridge in such associated clip as the slide moves forward. The selector cam and the stripper bars are configured to bear against each other so that when the selector button is in the first position, one stripper bar moves into the "on" position and the other into the "off" position, and when the selector button is moved to the second position the stripper bars move to their respective opposite positions. There is also a ramp system configured to guide cartridges stripped from such magazine towards the chamber.

According to one aspect of this invention, the ramp system of the dual cartridge firearm may comprise movable ramps on the firearm, there being a movable ramp associated with each clip. Each ramp may be movable between a tilted position in which it is positioned for contact by the front end of a cartridge stripped from an associated clip, and for guiding the front end of the cartridge upward as it advances towards the barrel, and an elevated position in which the ramp cooperates with at least the other ramp to support a cartridge thereon in alignment with the barrel. The ramps and the slide may be configured to engage each other such that the ramps are moved from their tilted positions to their elevated positions as the slide moves towards the barrel.

Optionally, there may be a guide member situated above the ramps to cooperate with the ramps, when the ramps are in their elevated positions, to define a pre-chamber within which a cartridge from the magazine can be disposed for alignment with the chamber before it is advanced into the chamber.

Also, optionally, there may be a lift cam and follower engagement between each ramp and the slide-bolt assembly.

The dual cartridge firearm of this invention is preferably combined with a dual clip magazine mounted thereon. Preferably, there is a different kind of cartridge in each clip of the magazine.

A third broad aspect of this invention relates to a magazine for holding firing cartridges, comprising a box with an open top end and a divider centrally disposed therein to define two compartments in the box. There are two clips at the top end of the box, extending from the center of the box towards the sides of the box, and a spring and stack follower in each compartment.

As used herein, the term "forward" indicates the direction in which a bullet is fired from the subject firearm, and "rearward" is the opposite direction.

DETAILED DESCRIPTION OF THE INVENTION AND PREFERRED EMBODIMENTS THEREOF

The present invention provides three broad novel features. First, there is a cartridge handling system that provides improved alignment of cartridges with the firing chamber prior to entry of the cartridge into the chamber. Second, the invention provides a dual cartridge weapon and magazine in which two sets of cartridges can be stored in a magazine and the user can select, on a cartridge-by-cartridge basis, which of the sets of cartridges to next employ. Third, there is a dual clip magazine, as described below.

A firearm according to a preferred embodiment of this invention is a magazine-fed pistol in which the magazine is removably mountable on the frame portion of the pistol. The frame usually comprises at least a handgrip portion formed integrally therewith. The frame carries the barrel of the weapon, which may either be formed integrally with the frame or may be a separate piece mounted thereon. In addition to receiving the magazine, the frame carries a slide-bolt assembly thereon and a firing mechanism (trigger, hammer or firing pin, etc.) therein. The present invention comprises one or more pivoting ramps that align a cartridge with the firing chamber in the barrel.

In the illustrated embodiments, alignment starts with the nose of the cartridge sliding up a ramp, and then proceeds with the rear of the cartridge moving upward as the stack of cartridges in the magazine below the one being fed rises. The cartridge does not lie flat on the ramp during the initial pivoting motion of the ramp; this occurs only as the ramp approaches its uppermost position. Furthermore, the cartridge does not stop on the ramp, but moves continuously across it until the feeding process is completed. These optional features will be evident from the following description.

Figure 1:
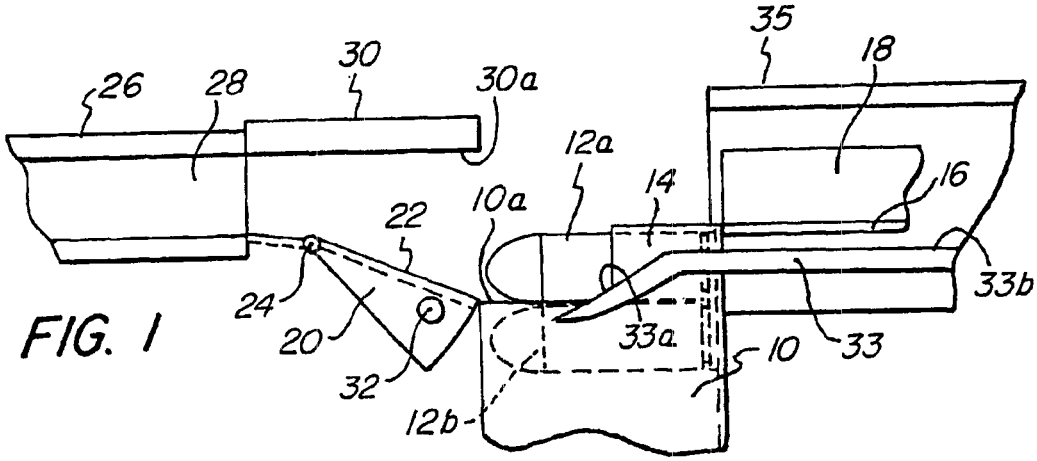
FIGS. 1 through 5 are schematic, cross-sectional views of a cartridge handling system in accordance with a first embodiment of the present invention.

A first particular embodiment of this invention is seen in FIG. 1, which is a partial view of a firearm comprising an improved cartridge handling system in accordance with a first aspect of this invention. FIG. 1 shows a magazine 10 that holds a plurality of cartridges 12*a*, 12*b*, etc., and that is removably mountable on the frame of the firearm. The magazine defines a pair of clips 14 that releasably hold the uppermost cartridge in place before it is chambered. The clips define a gap between them through which a flange 16 on bolt 18 can pass when the bolt is thrust forward. As is typical in the art, a cartridge in magazine 10 is situated directly below the barrel of the firearm, i.e., it is vertically misaligned with the barrel, although it is laterally aligned with the barrel (i.e., not displaced to the left or right of the barrel axis).

The cartridge handling system further comprises a ramp 20 having a ramp surface 22. Ramp 20 is pivotably mounted in the firearm at a pivot joint 24. Ramp 20 is positioned between magazine 10 and the firearm barrel 26 so that ramp surface 22 extends from magazine to the firing chamber 28 in the barrel 26. Above ramp 20 there is an upper guide member 30 mounted on the firearm. An optional guide member 30 provides a guide surface 30*a* that is aligned with the top interior surface of the firing chamber 28. Ramp 20 also comprises a cam follower 32. Cam follower 32 is configured to engage the surface of a lift cam 33 carried on a slide 35 for the firearm. Lift cam 33 has a raising surface 33*a* and a high cam surface 33*b*. A spring, not shown, biases ramp 20 downward so that cam follower 32 rests on lift cam 33. The raising surface 33*a* is responsible for the upward and downward motion of the ramp 20, whereas the high cam surface 33*b* holds the ramp 20 in the raised position.

As seen in FIG. 1, clips 14 extend beyond a top edge 10*a* of magazine 10 so that the tip of the top cartridge is positioned above the top edge of the magazine. Also, ramp surface 22 provides a ramp from the top edge of magazine 10 to the interior of firing chamber 28.

Figure 2:
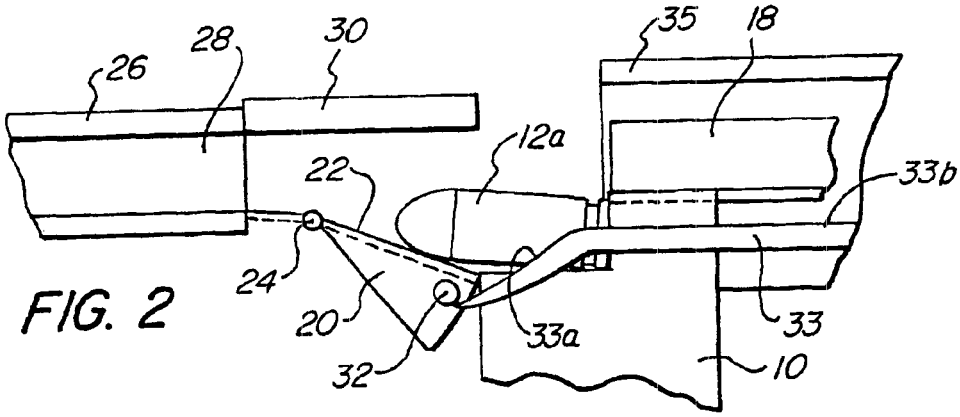
Figure 3:
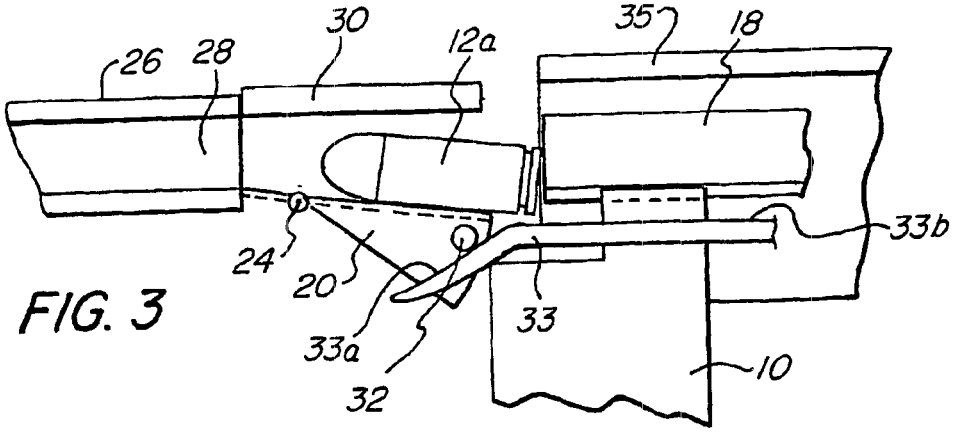
Figure 4:
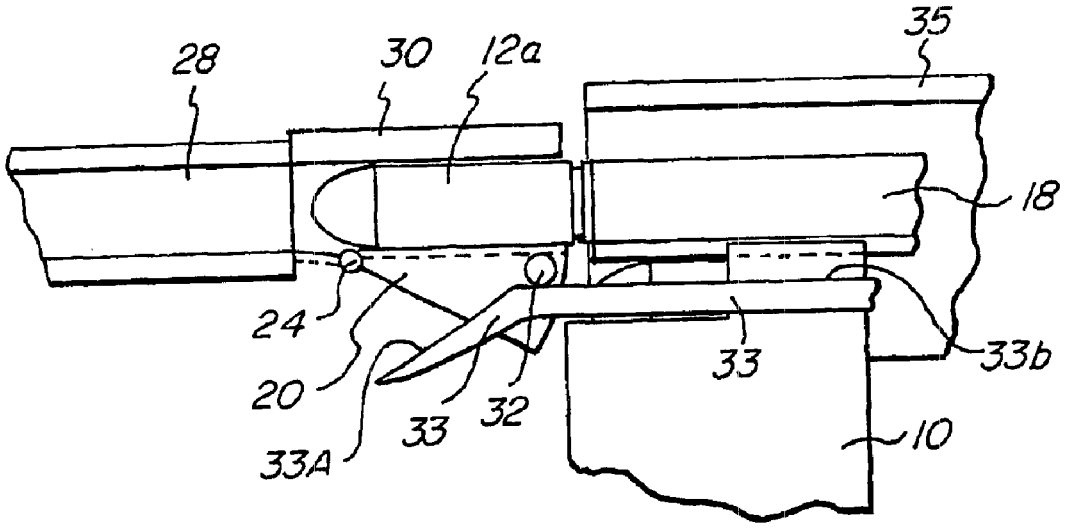
Figure 5:
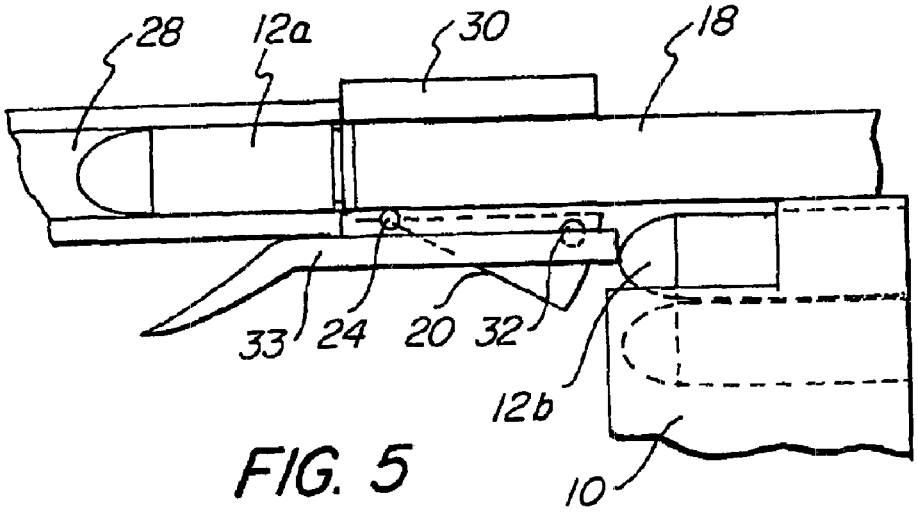

In use, once the magazine 10 has been mounted in the firearm, the user advances the slide to advance bolt 18. Flange 16 enters the gap between clips 14 and catches the top edge of the top cartridge 12*a*, advancing the cartridge into contact with ramp surface 22 on ramp 20, as shown in FIG. 2. Once the cartridge clears clips 14, the raising surface 33*a* of lift cam 33 engages the cam follower 32 on ramp 20, causing ramp 20 to pivot upward as indicated in FIG. 3. The upward motion of ramp 20 lifts the front end of cartridge 12*a* towards upper guide 30 by pivoting ramp 20 about pivot joint 24. Simultaneously, the magazine's internal spring (not shown) forces the stack of cartridges 12*a*, 12*b*, etc., upward. The top cartridge 12*a* is thus lifted both by the movement of ramp 20 and by the rise of the cartridge stack, with the ramp acting at the front of the cartridge and the stack acting at the rear. Before bolt 18 is fully advanced, ramp 20 has been fully pivoted so that follower 32 rests on high cam surface 33*b*. The ramp 20 is thus positioned so that ramp surface 22 and guide surface 30*a* cooperate to define a "pre-chamber" within which cartridge 12*a* is aligned for insertion into chamber 28, as shown in FIG. 4. The bolt is then fully advanced, pushing cartridge 12*a* into the firing chamber, as shown in FIG. 5. This forward motion of the bolt simultaneously advances the cartridge towards the chamber and lifts the cartridge into alignment with it by virtue of the associated motion of lift cam 33, ramp 20 and the cam and follower engagement between them.

Upon subsequent retraction of the slide and bolt, the cam surface on the slide permits ramp 20 to pivot downwards to its original position.

During the advancement of bolt 18, the cartridge 12*b* rising in magazine 10 towards the clips 14 does not fully engage clips 14 because of the protrusion of flange 16 therein. Upon subsequent retraction of the slide and bolt 18, flange 16 is removed from the gap in clips 14 and cartridge 12*b* rises into place for the next round.

This system of "pre-chambering", i.e., the substantial alignment of a cartridge with its firing chamber before it is inserted therein, is a central feature of this invention. With it, cartridges of various designs can be reliably fed into any firing chamber of proper size. The semi-automatic pistol's usual requirement for ammunition which is closely matched to the needs of its mechanism is eliminated. Pistols can be created to handle cartridges whose shapes are not completely known, perhaps not yet designed, such as the coming generation of "non-lethal" cartridges. This invention's system of splitting the task of elevating cartridges between a pivoting ramp, and a stack of cartridges rising under spring pressure, greatly reduces the bulk of the pre-chambering mechanism, making it suitable for use in small weapons.

As indicated above, this invention provides a second feature, namely, a selectable stripping mechanism for selecting a cartridge from one of a pair of parallel but independent cartridge magazine clips in the firearm. This feature allows the user to select, on a round-by-round basis, which of two cartridges will be used as the next firing round. Optionally, this permits the user to employ two different kinds of cartridges in the weapon. This feature is useful for various purposes, including law enforcement. In recent years it has become apparent that there is a need for a new type of weapon for use by police officers. Current police practices place much more emphasis on the use of firearms than those of the past. Officers often find that there is little middle ground between mere words and deadly force. In the last few years there have been several highly publicized shootings of civilians by police over misunderstandings in tense situations in which it was eventually determined that the civilians had done little or nothing wrong. Statistics have since revealed that this actually happens about one thousand times each year in the United States alone. Clearly there is a need for a "non lethal" weapon to be used in these situations.

There already exist several "non-lethal" firearms intended for police, such as shot-guns that fire rubber or plastic projectiles. It is also possible to fit such projectiles to ordinary pistol cartridges, but this is seldom done because it yields a non-lethal weapon which may prove to be inadequate in some situations. To use both lethal and non-lethal pistol cartridges, an officer would have to carry two pistols, both of them ready and easily accessible at all times. This is costly and difficult to arrange, as officers carry so much equipment already. Clearly there is a need for a pistol that can fire two types of cartridge, lethal and non-lethal, without reloading. Other combinations of types of cartridges can be employed in this invention as well.

Preferably, the "dual cartridge" pistol of this invention also incorporates a "pre-chambering" mechanism as disclosed herein.

Prior art dual cartridge weapons usually involved two more-or-less complete mechanisms on the same frame, i.e., two barrels, two magazines, etc. A firearm of this invention has either a dual clip magazine or, alternatively, two separate magazines, but it has only one barrel and one mechanism to chamber and fire cartridges. The two types of cartridges that can be stored in the magazine(s) must therefore be the same caliber, and their casings must both fit properly in the chamber. Their projectiles, however, can be very different.

Figure 6:
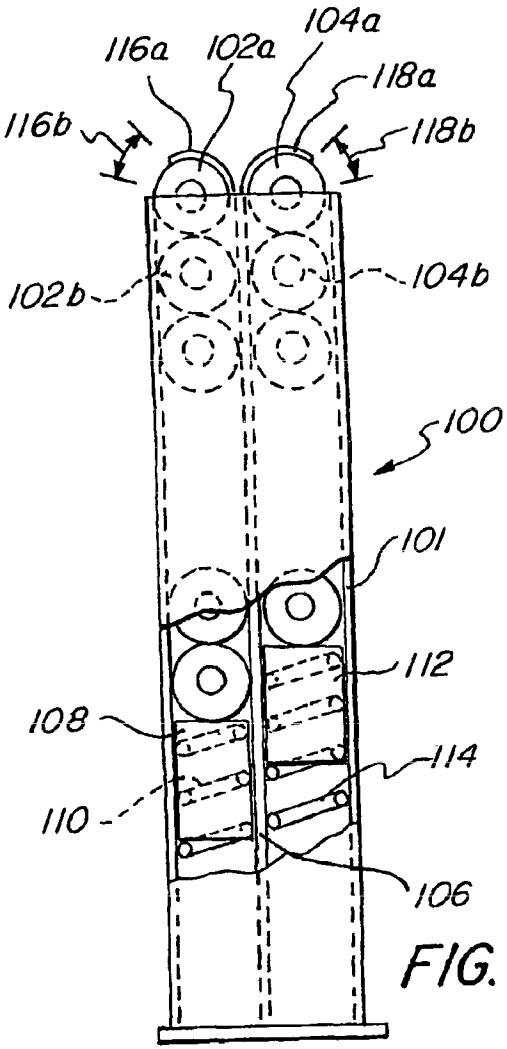
FIG. 6 is a partly cross-sectional rear elevation view of a dual-stack magazine in accordance with a second embodiment of the present invention.

A dual clip magazine according to this invention is shown in FIG. 6. Magazine 100 comprises a box 101 that is open at the top end with a divider 106 therein that defines two compartments in the box for two parallel columns of cartridges 102*a*, 102*b*, etc., and 104*a*, 104*b*, etc. A stack follower 108 and spring 110 advance cartridges 102*a*, 102*b*, etc., upward while a separate stack follower 112 and spring 114 advance cartridges 104*a*, 104*b*, etc., so that the cartridges in one column can move independently from cartridges in the other. Clips 116*a* and 118*a* at the open top of the box extend from the center of box 101, e.g., from divider 106, outwardly towards the sides of the box, leaving a gap at each side. The cartridges are releasably retained in magazine 100, and can be independently stripped from clips 116*a* and 118*a*. In an alternative configuration, two separate magazines, one a mirror image of the other, can be used side by side. In either case, the cartridges in clips 116*a* and 118*a* are out of alignment both laterally and vertically with the chamber of the firearm (i.e., they are below the axis of the barrel and displaced to the left and right of it), as is evident from the Figures.

Figure 7A:
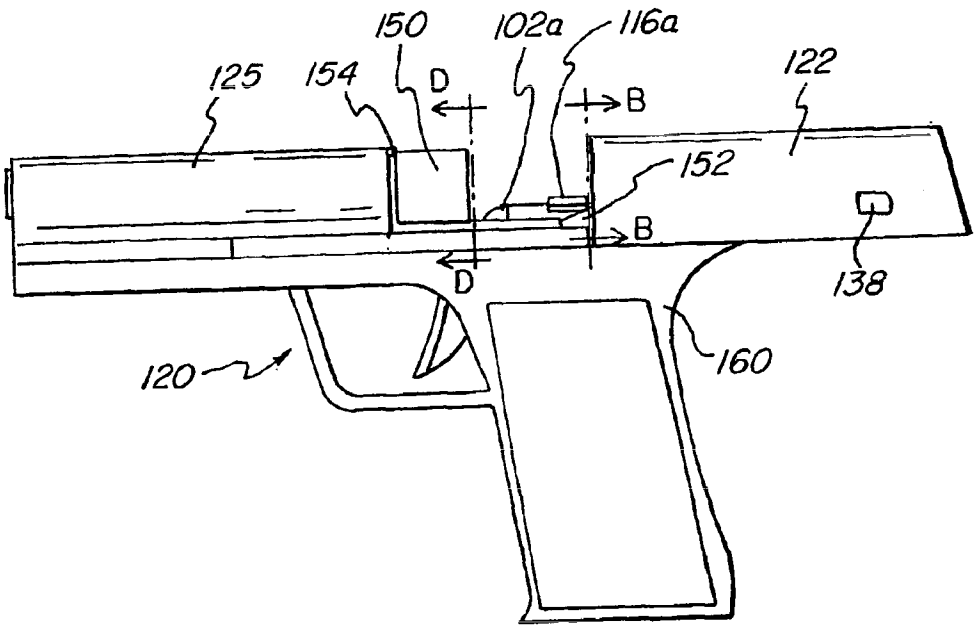
FIG. 7A is a schematic elevation view of a dual cartridge pistol according to one aspect of this invention with the slide fully withdrawn to expose a cartridge and the guide member.

In a firearm with the dual clip feature of this invention, cartridges are stripped from the magazine by the action of a selectable stripping mechanism carried on the frame (either directly thereon, or on the slide, or partly on both). The selectable stripping mechanism includes flange members or "stripper bars" that are configured to enter the gaps defined by the clips and thus engage either of the top cartridges in the magazine. The stripper bars are movable so that the user can select only one of them to strip a cartridge from the magazine. A selectable stripping mechanism of this kind is seen in firearm 120 of FIGS. 7A, 7B and 7C.

Slide 122 moves forward and rearward on frame 160 and carries a support member 129 (FIG. 7B) on which a bolt 124 is mounted for advancing a cartridge towards the firing chamber of the weapon, in barrel 125. An extractor 126 is carried on bolt 124 for extracting spent shells in a conventional manner. Support member 129 also carries two stripper-follower members that each comprise a shaft on which are mounted a stripper bar and a cam follower, with the shaft being rotatably mounted in the support member. Thus, support member 129 carries two shafts 129*a*, 129*b*, on which two stripper bars 128 and 130 and two associated cam followers 128*a* and 130*a* are mounted, respectively. Each stripper-follower member (and the stripper bar thereon) is rotatable between two positions. In the first position, the stripper bar can enter the gap defined by one of the clips and engage a top cartridge in the magazine to strip the cartridge as the slide is advanced on the firearm. In the second position, the stripper bar rides over the cartridge without engaging it. In the illustrated embodiment, the stripper bars are biased by springs, e.g., spring 133 (FIG. 7C) towards their first positions, i.e., to the positions in which they strip cartridges from the magazine. Preferably, slide 122 also carries lift cams 152, 154 which operate, as described below, in manners similar to lift cam 33 (FIG. 1).

Slide 122 carries a selector bar 138 on which a selector cam 132 is mounted. Selector cam 132 defines cam surfaces 134 and 136, against which cam followers 128*a* and 130*a* bear under the force of their respective biasing springs. Selector cam 132 is movable sideways within slide 122 so that, in moving to one side, it can push one stripper-follower member to its second position, i.e., to a position in which the stripper bar does not strip a cartridge from the magazine, while the other stripper-follower member moves to its first position, i.e., to a position in which the stripper bar will strip a cartridge from the magazine. The ends of selector bar 138 protrude from the firearm.

Figure 7B:
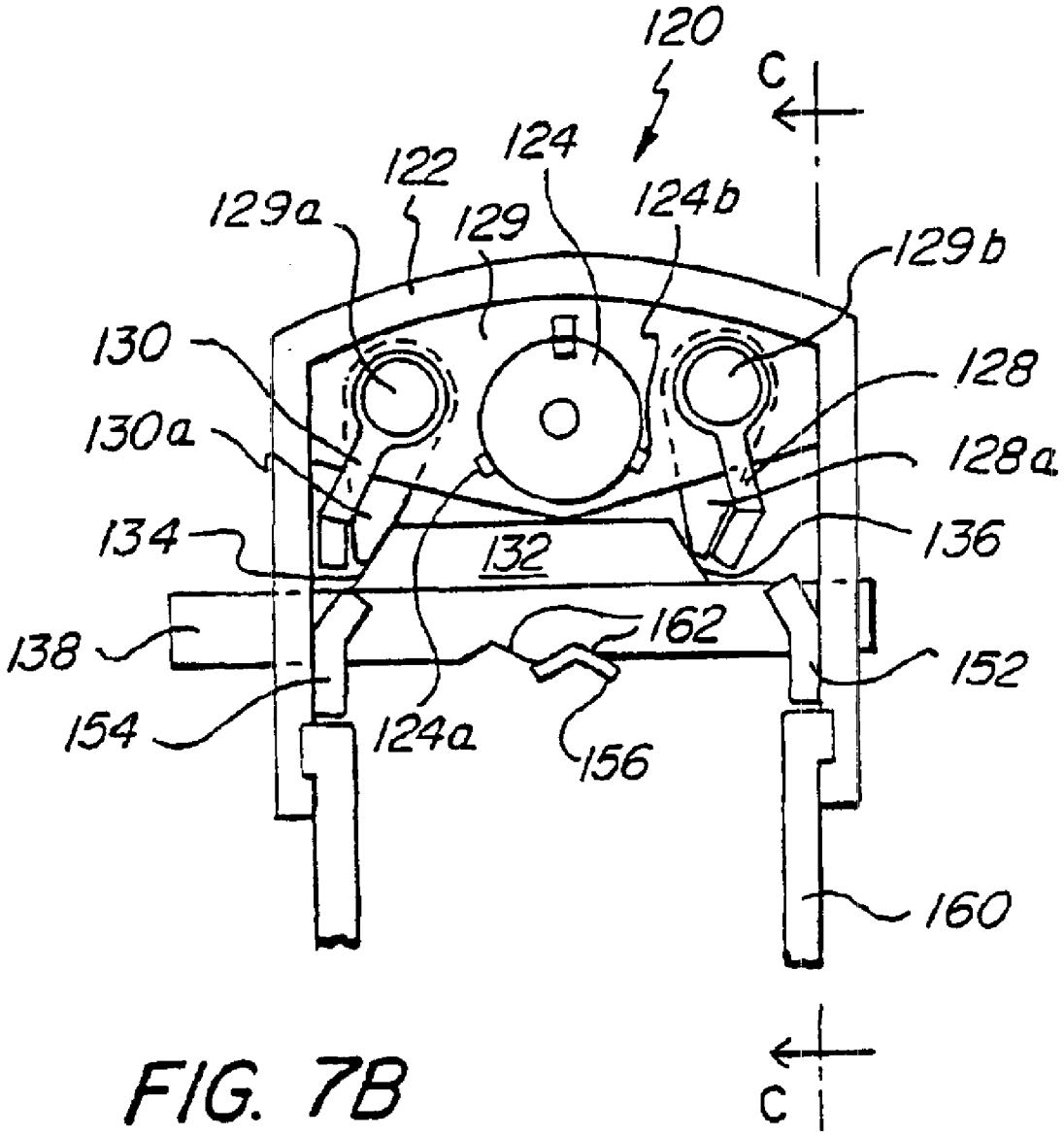
FIG. 7B is a schematic cross-sectional view of the dual cartridge handling system of the pistol of FIG. 7A in accordance with a particular embodiment of the present invention, taken along lines B–B of FIG. 7A.

The user moves selector cam 132 by pushing in one end or the other of selector bar 138 prior to firing a round. As shown in FIG. 7B, selector cam 132 has been moved toward the user's right (i.e., to the left in the Figure), e.g., by pushing the left end of selector bar 138 into the slide 122 of the firearm. This movement allowed follower 130*a* and stripper bar 130 associated therewith to pivot downward into a "first" position in which stripper bar 130 can strip a cartridge from the magazine. At the same time, follower 128*a* and the stripper bar 128 associated therewith have been moved to a "second" position in which the stripper bar 128 will not strip a cartridge from the magazine. Thus, in the configuration shown in FIG. 7B, the forward movement of slide 122 will cause stripper bar 130 to enter gap 116*b* (FIG. 6B) and strip the top cartridge from the left-side compartment of magazine 100. Stripper bar 128 will not engage a cartridge in clip 118*a* because selector cam 132 has pushed it (via its associated cam follower 128*a*) to its second, non-functioning position. A spring detent 156 settles in one of two associated notches 162 in the selector bar 138, and assures that it remains in the position selected.

Figure 8:
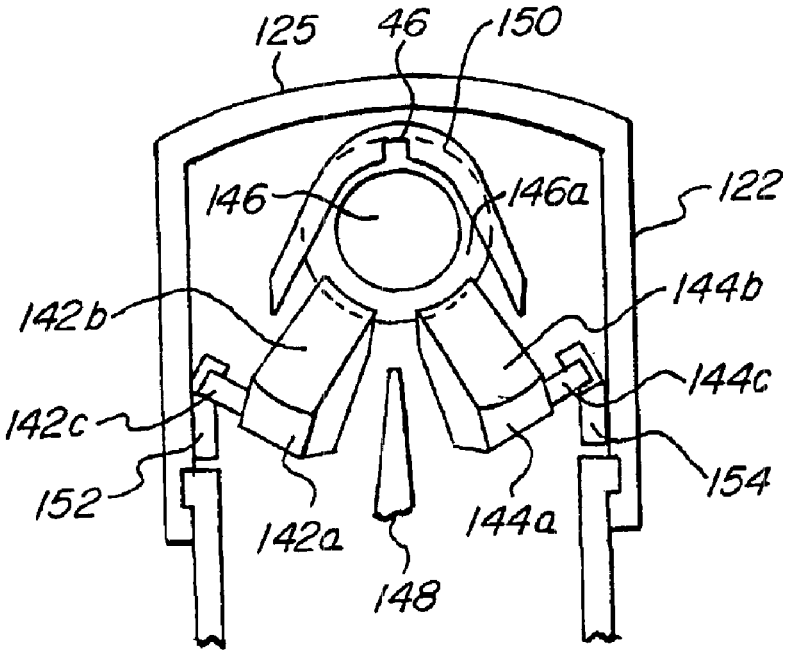
FIG. 8 is a cross-sectional view of the pistol of FIG. 7A taken along lines D—D of FIG. 7A.

Neither of the cartridges in the clips 116*a*, 118*a* of magazine 100 is aligned with the firing chamber, so the firearm must be configured to guide a cartridge from either clip to the chamber. This could be done with a ramp system provided by a fixed, funnel-like antechamber, but this invention advantageously provides a variant of the movable ramp system described above for a single cartridge magazine. The components of the dual cartridge movable ramp system of this invention, are shown in FIG. 8, which provides a schematic forward partial cross-sectional view of firearm 120 of FIG. 7A taken in the direction across lines D—D. As seen in this Figure, firearm 120 comprises pivoting guide ramps 142*a* and 144*a* having respective concave guide surfaces 142*b*, 144*b* and cam followers 142*c*, 144*c*. Ramps 142*a* and 144*a* are pivotable about joints close to firing chamber 146 (e.g., joint 163, FIG. 10) from the lowered position shown in FIG. 8 and a pre-chambering position shown in FIG. 9. In the lowered position shown in FIG. 8, guide surfaces 142*b* and 144*b* are positioned to guide the top cartridge from an associated clip in magazine 100 (FIG. 6) towards firing chamber 146. Since the top cartridges are in side-by-side relation to each other, guide surfaces 142*b* and 144*b* not only have an upward disposition but they are also angled so that they extend inwardly from their associated clips to the centerline of the firing chamber 146. Between ramps 142*a* and 144*a* there is a vertical divider 148. In the early stages of the stripping operation, divider 148 helps retain a cartridge on one of guide ramps 142*a* or 144*a*.

FIG. 8 also shows that firearm 120 provides an optional guide member 150. Guide member 150 is situated above ramps 142*a* and 144*a* and is concave relative to them and flared open along the outer edges of the ramps so that it can receive, and provide a centering action for, a cartridge received from either guide ramp. Lift cam 152 has a low surface 152*a*, a raising surface 152*b* and a high cam surface 152*c*. (The functions of raising surface 152 and high cam surface 152*c* are analogous to those of raising surface 33*a* and high cam surface 33*b* (FIG. 1), as described above.) Lift cam 154 (FIG. 7A) is similarly configured. In the view of FIG. 8, cam followers 142*c*, 144*c* are resting on the low surfaces of cams 152 and 154.

Figure 9:
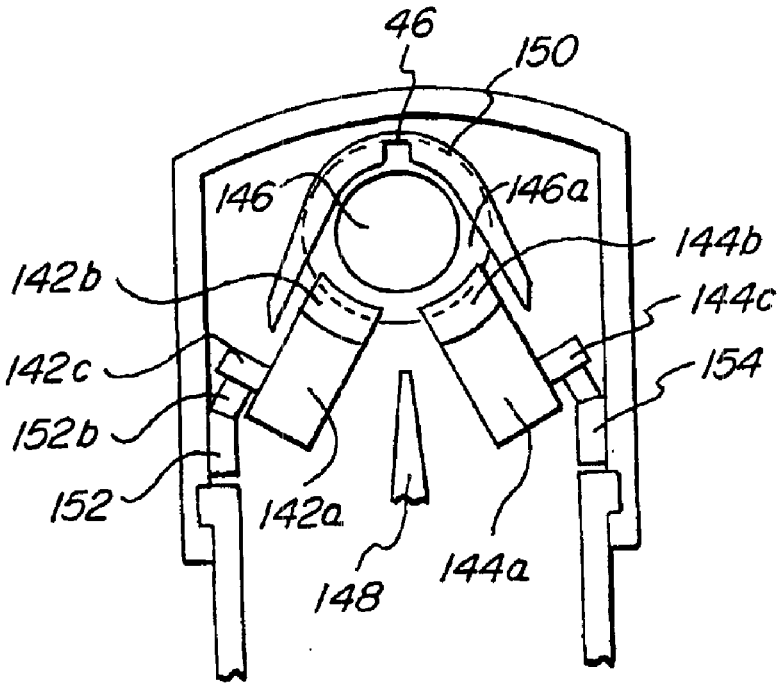
FIG. 9 is a view of the pistol of FIG. 8 showing movement of the ramps as a result of forward motion of the slide.
Figure 10:
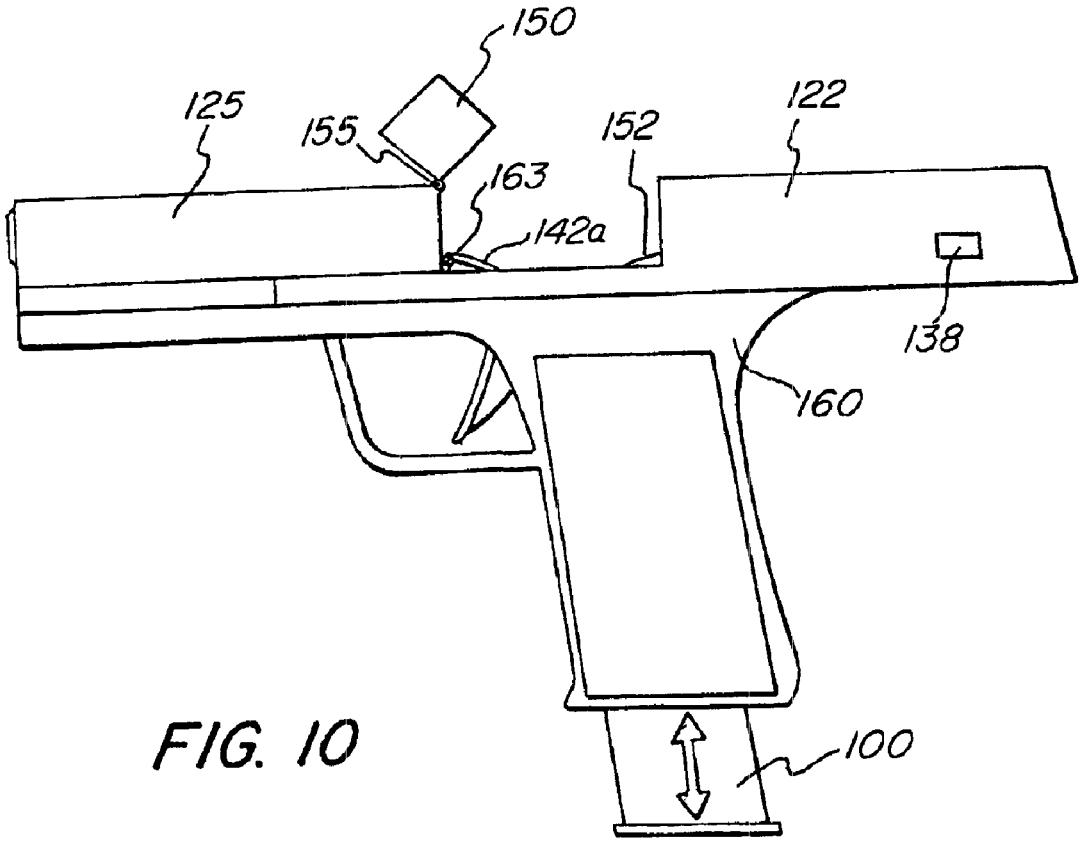
FIG. 10 is a schematic elevation view of the pistol of FIG. 7 showing the guide member pivoted upward and the magazine partially withdrawn from the butt of the pistol.

The action of the mechanism illustrated in FIG. 8 upon advancement of slide 122 is shown in FIG. 9. In this Figure, slide 122 has been advanced so that cams 152 and 154 have advanced and cam followers 142*c* and 144*c* have slid up the raising surfaces on cams 152 and 154 to the high surfaces of the cams, thus raising guide ramps 142*a* and 144*a* into their pre-chambering, i.e., elevated, positions (FIG. 9), in which they can cooperate with each other in supporting a cartridge in alignment with the chamber. Preferably, as shown, guide surfaces 142*b*, 144*b* have approached guide member 150, which cooperates with the ramps to define a "pre-chamber" configured to align a cartridge therein with the barrel chamber. At the same time, the stripper bar chosen by the user has stripped a cartridge (not shown) from one of the clips in the dual clip magazine, and the cartridge has been advanced along the surface of one of, and then both of, the guide ramps, and has been aligned laterally and vertically with the firing chamber 146. The cartridge is then further advanced into the firing chamber by further forward motion of the slide-bolt assembly.

Use of the weapon begins with the user selecting a cartridge from one stack or the other in the magazine by pushing the selector bar into one side or the other of the slide. The feeding process begins when slide 122 begins to move forward and both ramps are in their low positions, as seen in FIG. 8. This motion causes the stripper bar on the chosen side to move into the gap in the magazine's clips 116*a*, 118*a*, catch the base of either cartridge 102*a* or cartridge 104*a* and push the cartridge forward. Because the stripper bar catches the cartridge base near its edge, at a point on the opposite side from the centerline of the pistol's barrel, its thrust forces the front of the cartridge toward the barrel's centerline as the cartridge is moved forward.

As the front of the cartridge leaves the magazine, it mounts the pivoting guide ramp 142*a* or 144*a* closest to it. Constrained by the ramps 142*a*, 144*a* and the guide member 150, continued forward movement of a cartridge causes its front end to move upward and inward (toward the centerline) while the cartridge base moves forward in the clip, as is normal in box-clip-type magazines. The farther the cartridge moves, the farther up the ramp the front end slides. Thus the front end of the cartridge is continually elevated, while its base moves horizontally within the clip. The result is a tilt of the cartridge, which increases as it moves. During this part of the feeding process, the cartridge need not be parallel to the ramp. Instead, it may bridge between the magazine and the ramp, supported only at its front end, which is on the ramp, and its base, which is still retained by the magazine's clip. The front end also moves inward (toward the centerline) because of the cant of the ramp. Vertical divider 148 and guide member 150 keep the cartridge from leaving the ramp.

When the cartridge has moved far enough forward for its base to clear the magazine clips 116*a*, 118*a*, its base is elevated by the diameter of one cartridge as the spring pushes the stack follower and any cartridge(s) remaining thereon upwards. As the base of the stripped cartridge rises, the tilt of the cartridge diminishes and the base of the cartridge becomes disengaged from the stripper bar but comes into contact with the face of the weapon's bolt 124, which is mounted in the slide 122. The bolt then takes over the forward thrusting of the cartridge. Cams 152, 154 and followers 142*c*, 144*c* are preferably configured so that once the slide has advanced far enough for a cartridge to clear the clips, followers 142*c*, 144*c* encounter the raising surfaces of the cams 152 and 154, causing ramps 142*a* and 144*a* to tilt upward rapidly, around the pivots (e.g., pivot joint 163, FIG. 10) near their front ends. Ramps 142*a*, 144*a* rise simultaneously, even though, at first, only one ramp is guiding a cartridge. The cartridge is guided by its first ramp to move sideways toward the centerline, where it comes in contact with the other ramp as well. The ramp also raises the front end of the cartridge, but to a lesser degree than the cartridge base.

The cams 152, 154 are preferably shaped to roughly synchronize the changing tilt of the ramps with that of the cartridge. However, it is not necessary that the two angles match closely. Ideally, the ramps' movement should lag slightly behind the changes in the cartridge's tilt. As the ramps and the cartridge rise, the cartridge clears the top of divider 148 between the ramps. As the ramps rise farther, the guide member 150, which is tapered toward the top, will help the ramps to move the cartridge toward the centerline of the barrel, bringing it into alignment with the firing chamber 146.

Figure 7C:
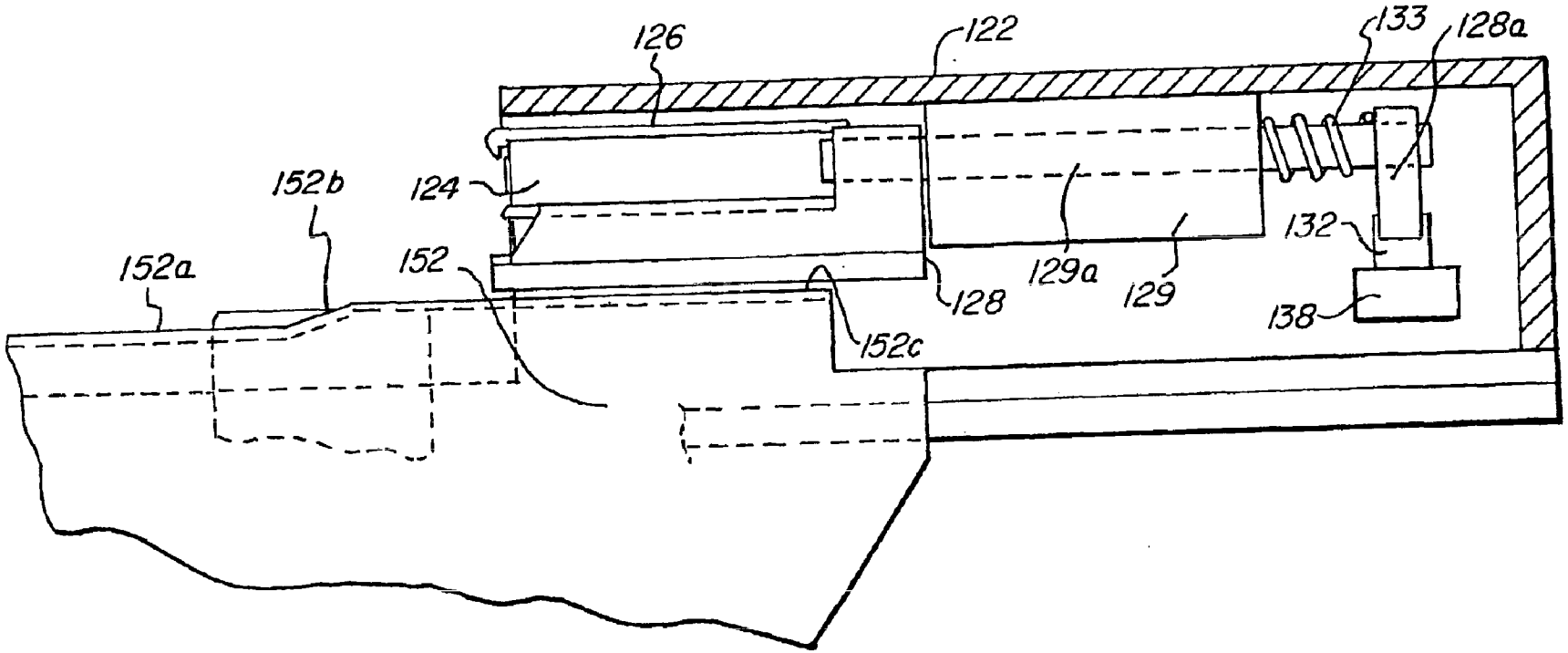
FIG. 7C is a cross-sectional view of the pistol of FIG. 7B taken along lines C—C of FIG. 7B.

As the cartridge nears the mouth of the firing chamber 146, the cams 152, 154 force the ramps into a horizontal position in which they cooperate to support the cartridge in alignment with the chamber. The ramp surfaces are parallel to the top of the guide member 150, so guide member 150 and ramps 142*a* and 144*a* cooperate to form a "pre-chamber" at the entrance of the chamber 146, within which the cartridge is pre-aligned for insertion into firing chamber 146. This pre-chamber is slightly larger than the diameter of a cartridge and is well aligned with the firing chamber 146. As the slide continues to move forward, the bolt 124, the front end of which is cantilevered so as not to need mechanical support in that area, and which is of a small enough diameter to fit into the pre-chamber, pushes the cartridge through the pre-chamber into the firing chamber. The cartridge seats in the firing chamber normally, and the bolt closes on it. The chamber includes a small funnel-shaped expansion of its mouth 146*a* (FIGS. 8 and 9), which serves to lead a cartridge into the chamber proper. This feature is known in the art as "throating". Extractor 126, which is of a conventional "pivoting hook" design, is shown on the top of the bolt, above the centerline. The small features or "shelves" 124*a*, 124*b* at the edge of the face of the bolt 124 in FIGS. 7C, 8 and 9 are configured to support the rim of a spent cartridge shell after it has been extracted from the chamber but before it is ejected. They are designed to fit into small gaps between the sides of ramps 142*a*, 144*a*, and guide 150. A slot 46 is provided in the guide member 150 to allow its passage. Other locations for the extractor are possible, such as on the bottom of the bolt, below the centerline, but the one shown is preferred.

The slide mechanism may be powered in any suitable manner for automatic or semi-automatic operation. Optionally, a "blowback" or "moving barrel recoil" system well-known in the art will be used. This invention is easily adaptable for use with many conventional trigger and hammer mechanisms.

After firing, the slide moves rearward in a conventional manner, extractor 126 pulling the spent cartridge with it. When it reaches an appropriate point, it encounters an ejector (not shown), which may be of a design well-known in the art, e.g., either a simple "knuckle" or a lever system. As is shown in the weapon of FIG. 7, the slide 122 opens the entire area behind the firing chamber as it moves rearward. The area immediately behind the breech is covered by the guide member 150, so a spent cartridge must move far enough rearward to clear it before an ejection is attempted. When the ejection is completed, the slide encounters its stops, which are also well-known in the art and so are not shown. The slide can then be moved forward again to begin a new feed process.

It is not necessary for the pre-chamber to fully enclose the cartridge. A length of about three-quarters of a cartridge length will be sufficient to contain and guide the cartridge. The length saved is useful in keeping the required slide travel to a minimum.

Because the guide member 150 effectively blocks access to the breech area, it can be mounted on the weapon with a simple hinge 155 (FIG. 10) so that it can pivot upwards and out of the way, as shown. A simple latching (not shown, but common in the art) can hold the guide member in its normal position as the weapon cycles normally. The arrangement shown is intended to show how the necessary access to the breech area can be provided. A hinge and latch system is a straightforward approach, but not the only one possible. For instance, an arrangement by which the guide could simply be lifted out of the frame would also serve the purpose. Alternatively, magnets might be used to secure guide 150. Recent developments in "rare earth" magnetic technology have led to the creation to small permanent magnets with startling holding power. These could be mounted in the frame near the breech, positioned to hold the guide 150 closed by magnetic attraction. Such holding is necessary only when the slide 122 is open. When closed, the slide fully encloses the guide, and can be arranged to physically hold it in position.

A cartridge can be selected either with the slide open or closed. A push on one end of the selector bar 138, which protrudes from both sides of slide 122, will move the selector cam 132 (FIG. 7A) to cause the stripper bar on the opposite side to rise to the "second" (non-functioning) position, while allowing the stripper bar on the same side to descend to its "first" (i.e., functioning) position under the pressure of its spring. Thus, when the selector bar 132 is pushed to the left by pressing its right side end into the slide, the left-side stripper bar rises above the top cartridge of the left-side stack in the magazine, but the right-side stripper bar descends and engages the top cartridge of the right-side stack in the magazine. If the selection is changed with the slide closed, the descending stripper bar will rest on the top cartridge of the stack on its side, and it will ride on the cartridge until the slide retracts far enough for the stripper bar to clear the base of the cartridge and descend into its normal functioning position. If a cartridge selection is changed while a cartridge is in the firing chamber, it will be necessary to cycle the weapon (pull the slide rearward to its stop and then release it) to remove the chambered cartridge (which will be ejected, as though it were a spent cartridge) and replace it with the type desired.

Auxiliary features commonly found in modem pistols, such as safety catches, slide hold-open catches, and "empty magazine slide hold-open" systems can be provided by existing designs, and so are not shown.

This invention is particularly useful in civilian law enforcement. It is anticipated that a police officer would normally travel with a "non-lethal" cartridge in the pistol's chamber. If it became necessary to fire, the first round fired would be non-lethal. If these rounds proved ineffective, and it became necessary to use lethal ammunition, it would be necessary only to press the appropriate side of the selector bar and cycle the pistol's mechanism manually, in the conventional manner of pulling the slide back and then releasing it. The cartridge that was in the chamber would be ejected, and the new one fed automatically. If necessary, the undesired cartridge in the chamber could be fired. The resulting cycle of the mechanism would eject the spent cartridge, and then feed one of the newly selected type.

While the invention has been described in detail with reference to particular embodiments thereof, it will be apparent that upon a reading and understanding of the foregoing, numerous alterations to the claimed embodiments will occur to those skilled in the art and will be recognized as falling within the spirit of the invention.

What is claimed:

1. In a firearm comprising a frame that carries a barrel having a chamber therein, a firing mechanism, and a slide-bolt assembly mounted on the frame for movement between a rearward position and a forward position, and a magazine mounted on the frame, the slide-bolt assembly being configured for stripping cartridges from said magazine and for advancing the cartridges towards the barrel as the slide-bolt assembly moves from said rearward position to said forward position, the improvement comprising:

a movable ramp on the firearm, the ramp being movable between a tilted position in which the ramp is positioned for contact by a cartridge stripped from said magazine mounted on the frame and for guiding the cartridge upward as the cartridge advances towards the barrel, and an elevated position in which the ramp is positioned to support a cartridge thereon in alignment with the barrel; and the ramp and the slide-bolt assembly being configured to engage each other such that as the slide-bolt assembly moves towards the barrel, the ramp is moved from the tilted position to the elevated position.

2. The firearm of claim 1 comprising a guide member situated above the ramp to cooperate with the ramp, when the ramp is in said elevated position, to define a pre-chamber within which a cartridge from the magazine can be disposed for alignment with the chamber before it is advanced into the chamber.

3. The firearm of claim 1 or claim 2, further comprising a lift cam and a follower engagement between the ramp and the slide-bolt assembly.

4. The firearm of claim 3 wherein the lift cam comprises a raising surface, and wherein the follower does not engage the raising surface until the slide-bolt assembly is advanced to a position sufficient to strip a cartridge from the magazine.

* * * * *